US010983454B2

(12) United States Patent
Sheng et al.

(10) Patent No.: US 10,983,454 B2
(45) Date of Patent: Apr. 20, 2021

(54) REFLECTIVE TONER LEVEL DETECTOR WITH RELATIVE ROTATING AND CLEANING

(71) Applicant: AVISION INC., Hsinchu (TW)

(72) Inventors: Shao-Lan Sheng, Hsinchu (TW); Sung-Po Cheng, Hsinchu (TW); Chiamin Kuo, Taichung (TW); Hsiang-Yun Cheng, New Taipei (TW)

(73) Assignee: AVISION INC., Hsinchu (TW)

( * ) Notice: Subject to any disclaimer, the term of this patent is extended or adjusted under 35 U.S.C. 154(b) by 0 days.

(21) Appl. No.: 16/911,924

(22) Filed: Jun. 25, 2020

(65) Prior Publication Data

US 2021/0018857 A1 Jan. 21, 2021

(30) Foreign Application Priority Data

Jul. 17, 2019 (TW) ..... 108125209

(51) Int. Cl.
*G03G 15/08* (2006.01)

(52) U.S. Cl.
CPC ..... *G03G 15/0862* (2013.01); *G03G 15/0889* (2013.01)

(58) Field of Classification Search
CPC ..... G03G 15/0862; G03G 15/0889
See application file for complete search history.

(56) References Cited

U.S. PATENT DOCUMENTS 5,383,007 A * 1/1995 Kinoshita ..... G03G 15/0893 399/65
5,557,368 A * 9/1996 Endo ..... G03G 15/0856 250/577
6,496,662 B1 12/2002 Buchanan et al.
2007/0071464 A1 3/2007 Yamaguchi
2015/0125167 A1 5/2015 Yamaguchi et al.

FOREIGN PATENT DOCUMENTS

CN 1940765 A 4/2007
CN 101833265 A 9/2010

OTHER PUBLICATIONS

Office Action dated Aug. 28, 2020 in TW Application No. 108125209.

* cited by examiner

*Primary Examiner* — Victor Verbitsky
(74) *Attorney, Agent, or Firm* — Muncy, Geissler, Olds & Lowe, P.C.

(57) ABSTRACT

A toner level detector includes a toner cartridge, an agitator, a reflective region, a first cleaner, a second cleaner and a transceiver. The toner cartridge stores toner, and has a light-permeable region. The agitator rotatably disposed in the toner cartridge agitates the toner. The reflective region is disposed on the agitator. The first cleaner is disposed on the agitator. The second cleaner is disposed on the toner cartridge. The transceiver disposed on a body outside the toner cartridge outputs an emitting signal to the reflective region through the light-permeable region. The reflective region reflects the emitting signal to generate a reflective signal received by the transceiver through the reflective region. The rotating first cleaner intermittently cleans the fixed light-permeable region, and the fixed second cleaner intermittently cleans the rotating reflective region.

8 Claims, 10 Drawing Sheets

REFLECTIVE TONER LEVEL DETECTOR WITH RELATIVE ROTATING AND CLEANING

CROSS-REFERENCE TO RELATED APPLICATIONS

This application claims priority of No. 108125209 filed in Taiwan R.O.C. on Jul. 17, 2019 under 35 USC 119, the entire content of which is hereby incorporated by reference.

BACKGROUND OF THE INVENTION

Field of the Invention

This disclosure relates to a toner level detector, and more particularly to a reflective toner level detector with relative rotating and cleaning.

Description of the Related Art

A toner cartridge is an indispensable assembly of a printer, and mainly functions to store toner and supply the toner in the printing process. The toner in the toner cartridge is decreased after documents have been continuously printed, and a toner level of the toner needs to be detected in real time so that the user can be notified to replace the toner cartridge timely. The conventional detection methods include an infrared transmissive detection method, a powder vibration detection method and a print quantity calculation method.

FIG. 1 is a schematic view showing a conventional toner level detection method. FIG. 2 is a partial pictorial view showing the toner level detection method in FIG. 1. A toner level detection method is disclosed in, for example, U.S. Pat. No. 6,496,662. As shown in FIGS. 1 and 2, a toner cartridge 310 is installed within a body 300 of a printer, an emitter 320 and a receiver 330 are installed on one side of the body 300, and a sidewall of the toner cartridge 310 is provided with a transparent window 311. When the toner level is low, the emitter 320 outputs a signal 340 to a reflective surface 350 through the transparent window 311, and the signal 340 is reflected by the reflective surface 350 and then reaches the receiver 330 through the transparent window 311. When the receiver 330 receives the signal 340, the toner level is judged as low. Because the low toner level needs to be judged, the transparent window 311 and the reflective surface 350 need to be disposed on a bottom of a chamber 315 of the toner cartridge 310, a rotating blade 360 is also disposed in the chamber 315, and a cleaner 370 is disposed on the rotating blade 360 to clean the fixed transparent window 311 and reflective surface 350 at the same time. Although the function of low toner detection can be achieved, the fixed reflective surface 350 needs to be supported by an extension 355, and a gap 380 between the reflective surface 350 located at an edge of the toner cartridge 310 and the transparent window 311 should not be too large (FIG. 1 is shown in an exaggerated manner), so that the toner tends to be divided into two areas by the fixed reflective surface 350 and extension 355, and the toner in the two areas cannot circulate easily (the toner is obstructed). Therefore, when the toner level is low, the toner which cannot flow easily still remains in the gap 380 between the reflective surface 350 and the transparent window 311; or when the toner level is high, the toner which cannot flow easily enters the gap 380 between the reflective surface 350 and the transparent window 311 too late, so that the toner level detection result is affected. In addition, the cleaner 370 cleans the fixed transparent window 311 and reflective surface 350 at the same time. So, the installation or manufacturing tolerances on both sides of the cleaner 370 need to be precisely controlled to prevent the cleaning results from being affected or to prevent the problem of non-smooth operation.

Therefore, the prior art still needs to be improved.

BRIEF SUMMARY OF THE INVENTION

It is therefore an objective of this disclosure to provide a reflective toner level detector with relative rotating and cleaning. By disposing a reflective region and a first cleaner on a rotating agitator and disposing a second cleaner on a toner cartridge, the first cleaner can clean a light-permeable region, and the second cleaner can clean the reflective region to achieve the function of detecting a toner level in conjunction with a transceiver.

Another objective of this disclosure is to provide a reflective toner level detector with relative rotating and cleaning. By respectively disposing the light-permeable region and the reflective region on two opposite sides of the toner cartridge, and respectively disposing the first cleaner and the second cleaner on two opposite sides of the rotating agitator, the first cleaner can clean the light-permeable region, and the second cleaner can clean the reflective region to achieve the function of detecting a toner level in conjunction with a transceiver.

To achieve the above-identified objects, this disclosure provides a toner level detector including a toner cartridge, an agitator, a reflective region, a first cleaner, a second cleaner and a transceiver. The toner cartridge stores toner and has a light-permeable region. The agitator is rotatably disposed in the toner cartridge and agitates the toner. The reflective region is disposed on the agitator. The first cleaner is disposed on the agitator. The second cleaner is disposed on the toner cartridge. The transceiver is disposed on a body outside the toner cartridge, and outputs an emitting signal to the reflective region through the light-permeable region. The reflective region reflects the emitting signal to generate a reflective signal received by the transceiver through the reflective region. The first cleaner, which is rotating, intermittently cleans the light-permeable region, which is fixed; and the second cleaner, which is fixed, intermittently cleans the reflective region, which is rotating.

This disclosure also provides a toner level detector including a toner cartridge, an agitator, a reflective region, a first cleaner, a second cleaner and a transceiver. The toner cartridge stores toner and has one side provided with a light-permeable region. The agitator is rotatably disposed in the toner cartridge and agitates the toner. The reflective region is disposed on an inner surface on the other side of the toner cartridge. The first cleaner is disposed on one side of the agitator. The second cleaner is disposed on the other side of the agitator. The transceiver is disposed on a body outside the toner cartridge, and outputs an emitting signal to the reflective region through the light-permeable region. The reflective region reflects the emitting signal to generate a reflective signal received by the transceiver through the reflective region. The first cleaner, which is rotating, intermittently cleans the light-permeable region, which is fixed; and the second cleaner, which is rotating, intermittently cleans the reflective region, which is fixed.

With the above-mentioned embodiments of this disclosure, the user can be accurately and timely notified to replace the toner cartridge. Alternatively, a supplemental toner cartridge can supplement the toner, and this is applicable to a dual-box toner cartridge capable of supplying toner according to the requirement, wherein a front end toner box instantly supplies the toner needed for printing, and a rear end toner box is used to store the toner. When the toner level of the front end toner box is judged to be low, the rear end toner box properly supplements the toner to the front end toner box. Such the operation can prevent the unused toner from being constantly agitated to affect the physical property of the unused toner (i.e., the lifetime of the toner can be lengthened). In addition, the embodiment of this disclosure is better than the infrared transmissive detection method because only the detector needs to be mounted on one single side, so that the electronic parts can be decreased and the assembling time can be shortened. Compared with the vibration detection method, the structure of the toner cartridge is relatively simple, the sensor needs not to be disposed inside the toner cartridge, and the electronic cables need not to be connected to the toner cartridge. Compared with the print quantity calculation method, the embodiments of this disclosure can obtain the more accurate results and can accurately determine the current toner level, and the continuously rotating reflective region can obstruct the circulation of the toner.

Further scope of the applicability of this disclosure will become apparent from the detailed description given hereinafter. However, it should be understood that the detailed description and specific examples, while indicating preferred embodiments of this disclosure, are given by way of illustration only, since various changes and modifications within the spirit and scope of this disclosure will become apparent to those skilled in the art from this detailed description.

DETAILED DESCRIPTION OF THE INVENTION

In embodiments of this disclosure, one single lateral infrared reflection design is adopted. Two sensors including an emitter and a receiver, both of which can be referred to as a transceiver, are disposed on the same side inside the machine. A toner cartridge needs to have a light-permeable region through which input and output signals can be transmitted. A cleaner is disposed on an agitator, and removes the toner from the light-permeable region in the agitating process.

Figure 1:
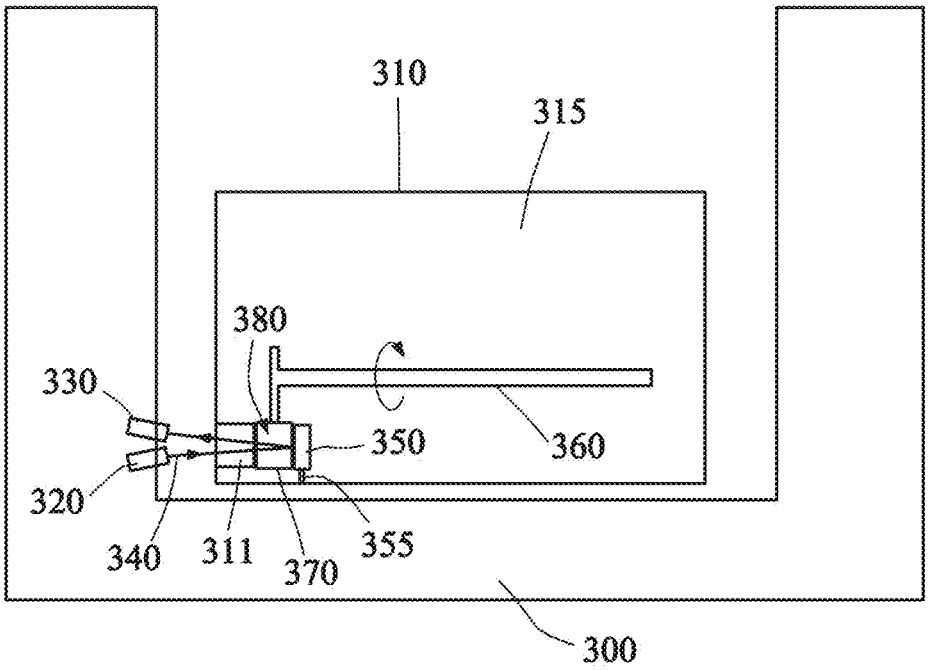
FIG. 1 (Prior Art)
FIG. 1 is a schematic view showing a conventional toner level detection method.
Figure 2:
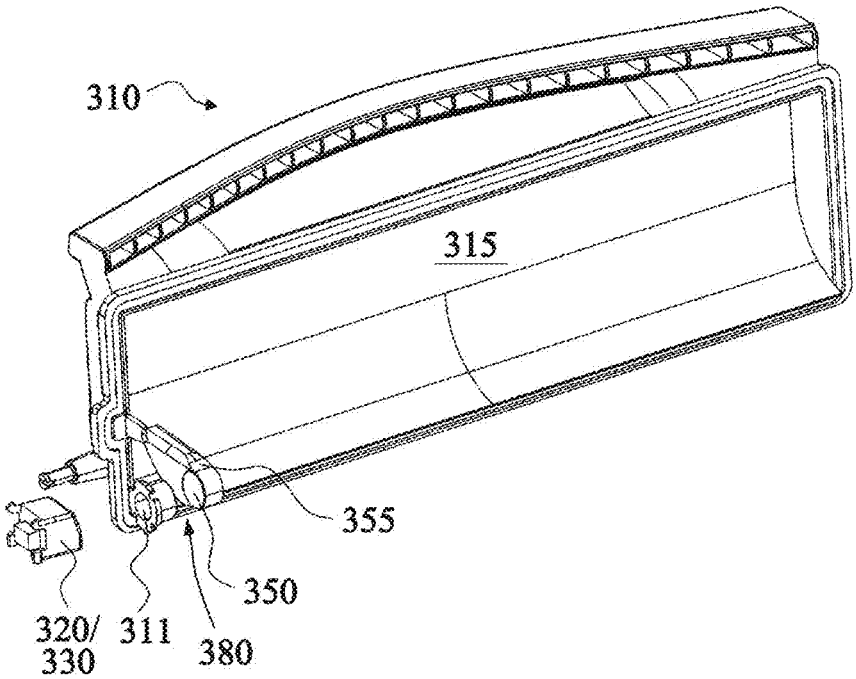
FIG. 2 (Prior Art)
FIG. 2 is a partial pictorial view showing the toner level detection method in FIG. 1.
Figure 3:
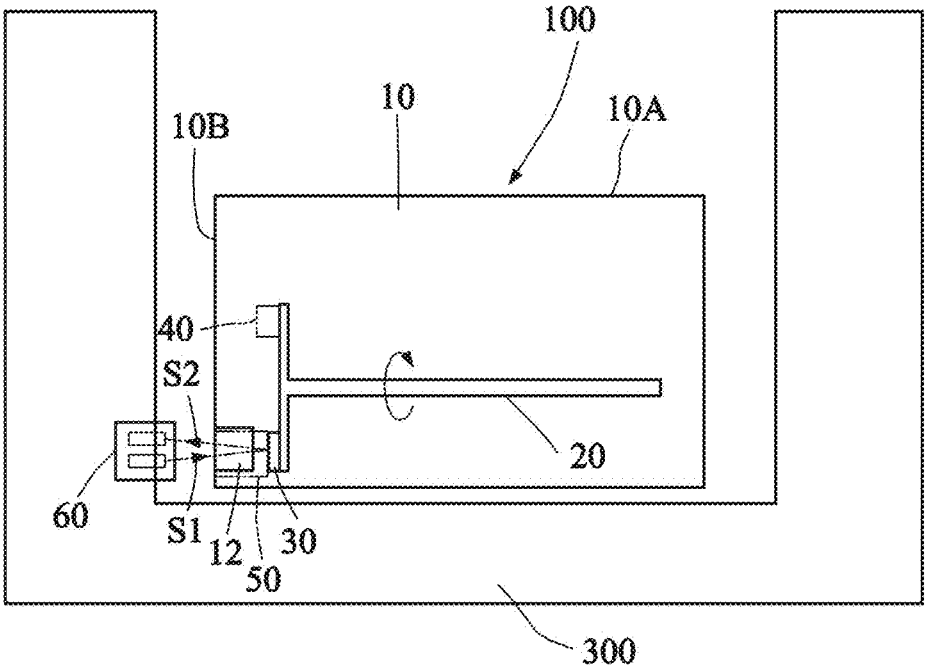
FIGS. 3 and 4 are schematic top views showing two states of a toner level detector according to a first embodiment of this disclosure.
Figure 4:
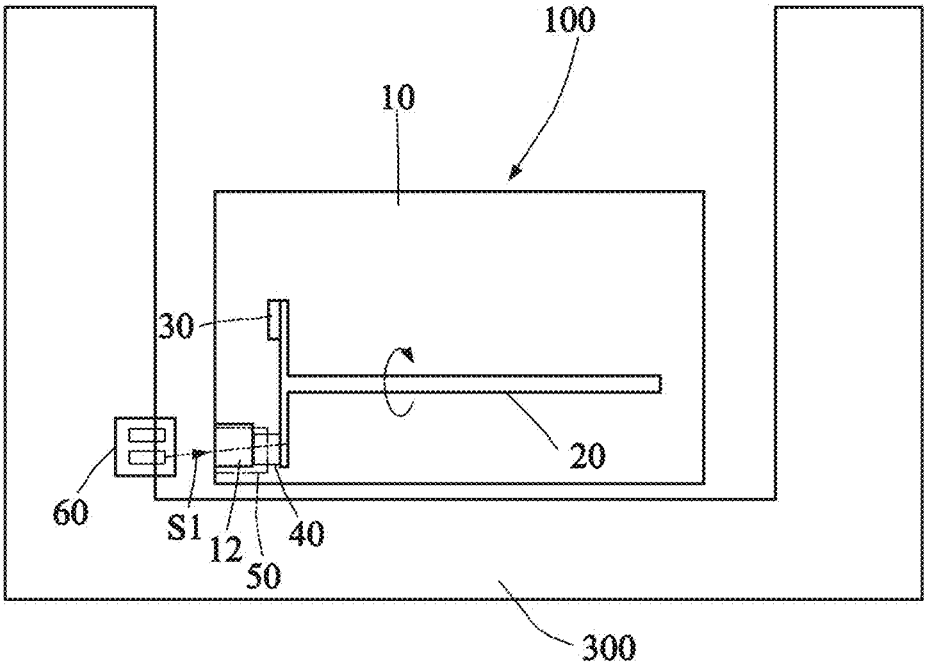

As shown in FIGS. 3 to 5 and 8 to 12, a toner level detector 100 according to the first embodiment of this disclosure is disposed in a body 300 of a printer, and includes a toner cartridge 10, an agitator 20, a reflective region 30, a first cleaner 40, a second cleaner 50 and a transceiver 60. It is worth noting that the agitator 20 in FIGS. 3 and 4 is only presented schematically.

The toner cartridge 10 stores toner, more particularly dry toner, and has a light-permeable region (or light transmitting region) 12. The toner cartridge 10 has a long side 10A and a short side 10B, the long side 10A is connected to the short side 10B, and the long side 10A is longer than the short side 10B. The light-permeable region 12 may be made of a light-permeable material and then fixed to the sidewall (short side 10B) of the toner cartridge 10 to seal an opening formed on the sidewall of the toner cartridge 10.

The agitator 20 is rotatably disposed in the toner cartridge 10, and agitates the toner. An axial direction of the agitator 20 is substantially parallel to the long side 10A, and is substantially perpendicular to the short side 10B.

The reflective region 30 is disposed on the agitator 20. The reflective region 30 may be implemented by an aluminum foil or another reflective sheet, and may also form a reflective portion, such as a white portion, having the reflecting ability using the material of the agitator 20.

The first cleaner 40 is disposed on the agitator 20, and may be implemented by a thin sheet, a brush or the like. Based on a rotation direction of the agitator 20, a phase difference between the first cleaner 40 and the reflective region 30 is equal to 180 degrees.

The second cleaner 50 is disposed on the toner cartridge 10, and may be implemented by a thin sheet, a brush or the like. The second cleaner 50 is disposed near the light-permeable region 12.

The transceiver 60 is disposed on the body 300 outside the toner cartridge 10, and outputs an emitting signal S1 to the reflective region 30 through the light-permeable region. The reflective region 30 reflects the emitting signal S1 to generate a reflective signal S2, which is received by the transceiver 60 through the reflective region 30, wherein the rotating first cleaner 40 intermittently cleans the fixed light-permeable region 12, and the fixed second cleaner 50 intermittently cleans the rotating reflective region 30. In one example, the transceiver 60 includes an emitter 61 and a receiver 62. The emitter 61 transmits the emitting signal S1, and the receiver 62 receives the reflective signal S2.

In FIG. 3, when the toner level is low, the reflective region 30 has been cleaned by the second cleaner 50, the emitting signal S1 reaches the reflective region 30 through the light-permeable region 12, and the reflective region 30 generates the reflective signal S2 transmitted to the transceiver 60 through the light-permeable region 12. In FIG. 4, the first cleaner 40 is at the position of cleaning the light-permeable region 12. It is worth noting that the operations of FIGS. 3 and 4 are performed continuously. Thus, after the light-permeable region 12 has been cleaned by the first cleaner 40, the reflective region 30 is cleaned by the second cleaner 50 again. At this time, the light-permeable region 12 and the reflective region 30 can be maintained in a state of not being blocked by the toner, so that the transceiver 60 completes the signal transmission and reception. In other words, after the fixed second cleaner 50 has cleaned the rotating reflective region 30, the reflective region 30 can be rotated to the opposite side of the light-permeable region 12.

Figure 5:
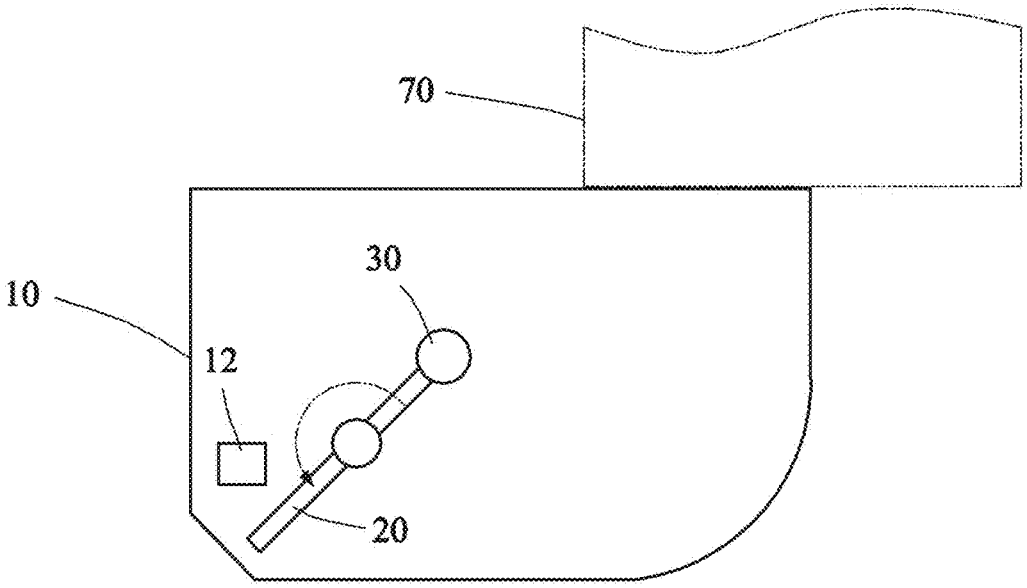
FIG. 5 is a schematic side view showing the toner level detector according to the first embodiment of this disclosure.
Figure 6:
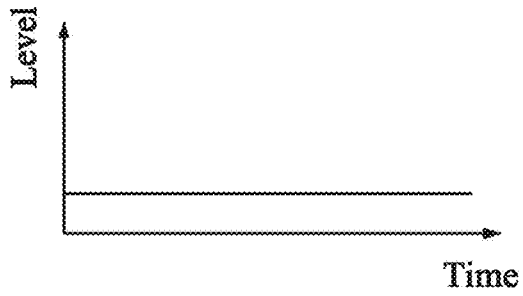
FIGS. 6 and 7 are timing charts showing a reflective signal received by a transceiver.
Figure 7:
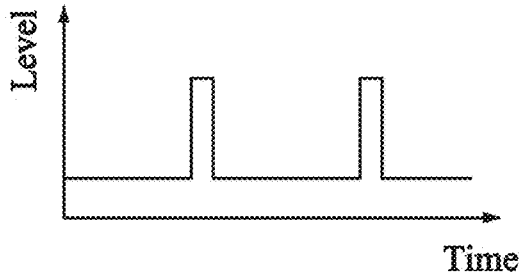

As shown in FIGS. 5 to 7, a processor (not shown) of the printer judges the toner level as high (FIG. 6) according to the reflective signal S2 kept at a low level because the signal is shielded or blocked by the toner; and judges the toner level as low (FIG. 7) according to a period when the reflective signal S2 is kept at a low level accompanying with one or multiple transitory high levels because the reflective region intermittently reflects the signal that is not shielded or blocked by the toner. When the toner level is judged as low, a supplement toner cartridge 70 may be enabled to supplement new toner into the toner cartridge 10, or a user is notified to replace the toner cartridge 10. This situation is also applicable to other embodiments.

Figure 8:
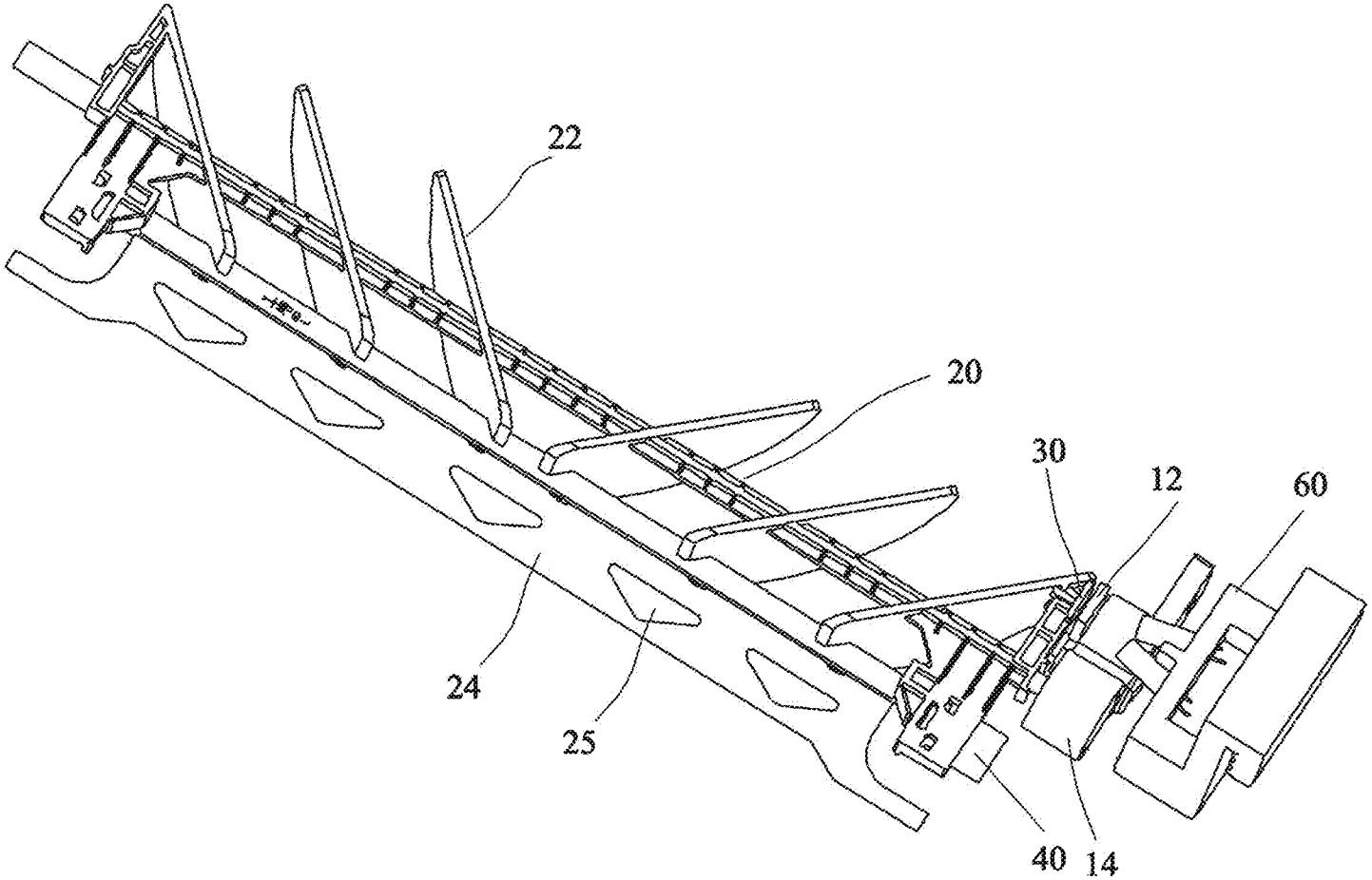
FIG. 8 is a pictorial view showing some members of the toner level detector according to the first embodiment of this disclosure.
Figure 9:
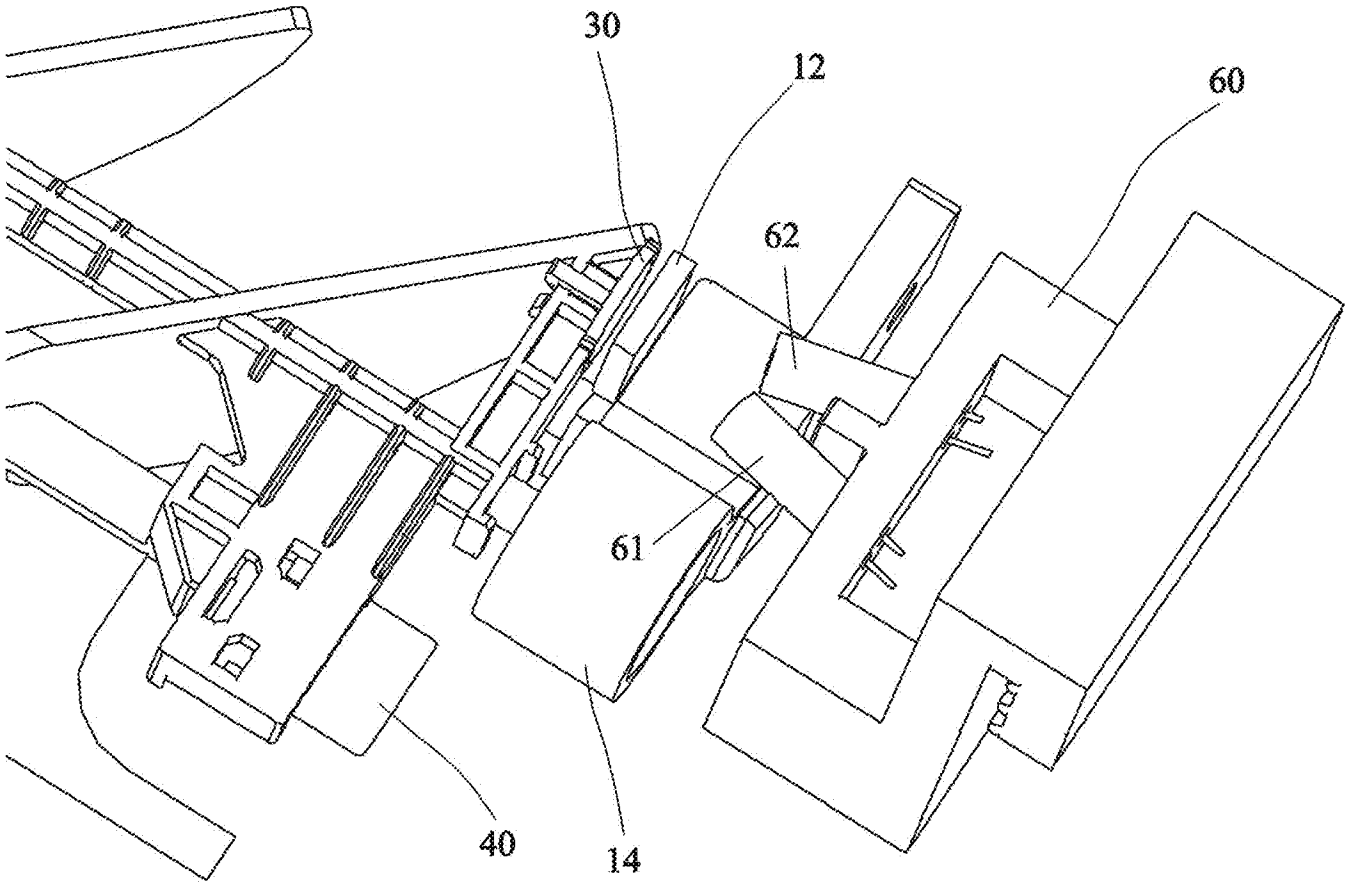
FIG. 9 is an enlarged partial view of FIG. 8.

As shown in FIG. 8, the agitator 20 in this embodiment has multiple paddles 22 and an elastic sheet 24, which has multiple holes 25 to facilitate flowing of the toner and stirs the toner to move upward from the bottom of the toner cartridge 10. The paddles 22 move the toner in a transversal direction. In another example, the elastic sheet 24 and the first cleaner 40 may be formed as an integrated component, which can be conveniently installed and assembled.

Figure 10:
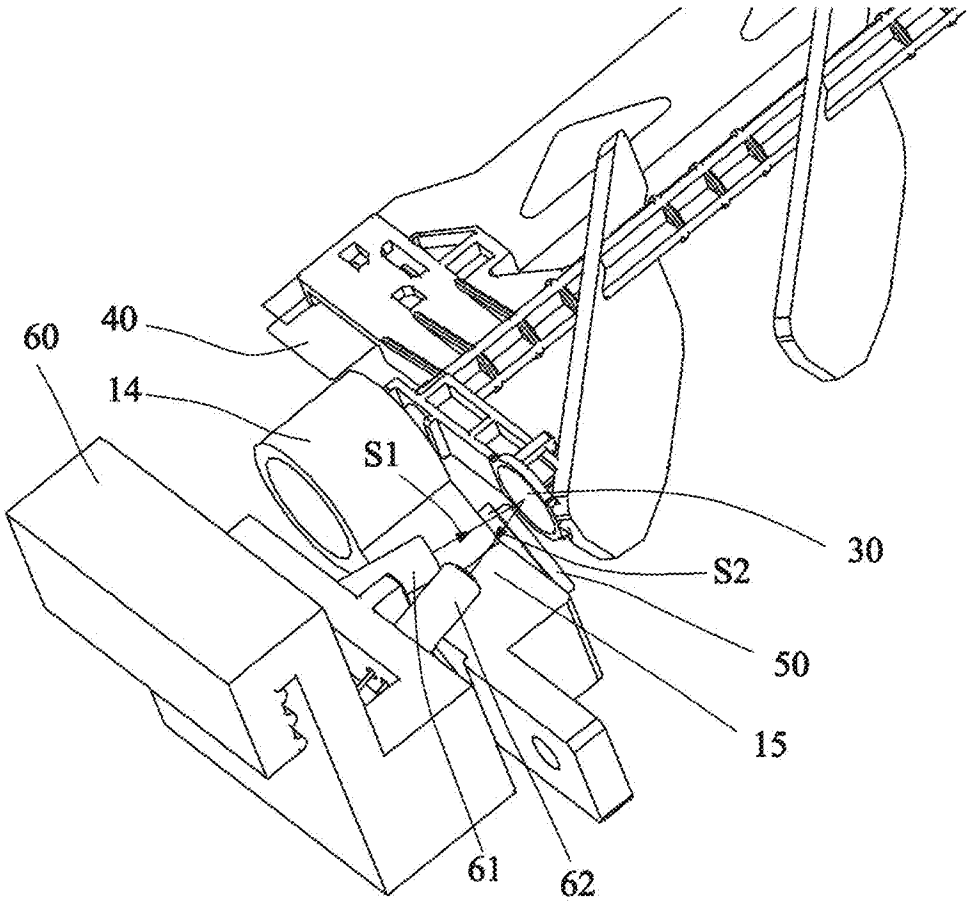
FIG. 10 is an enlarged partial view of FIG. 8 at another viewing angle.
Figure 11:
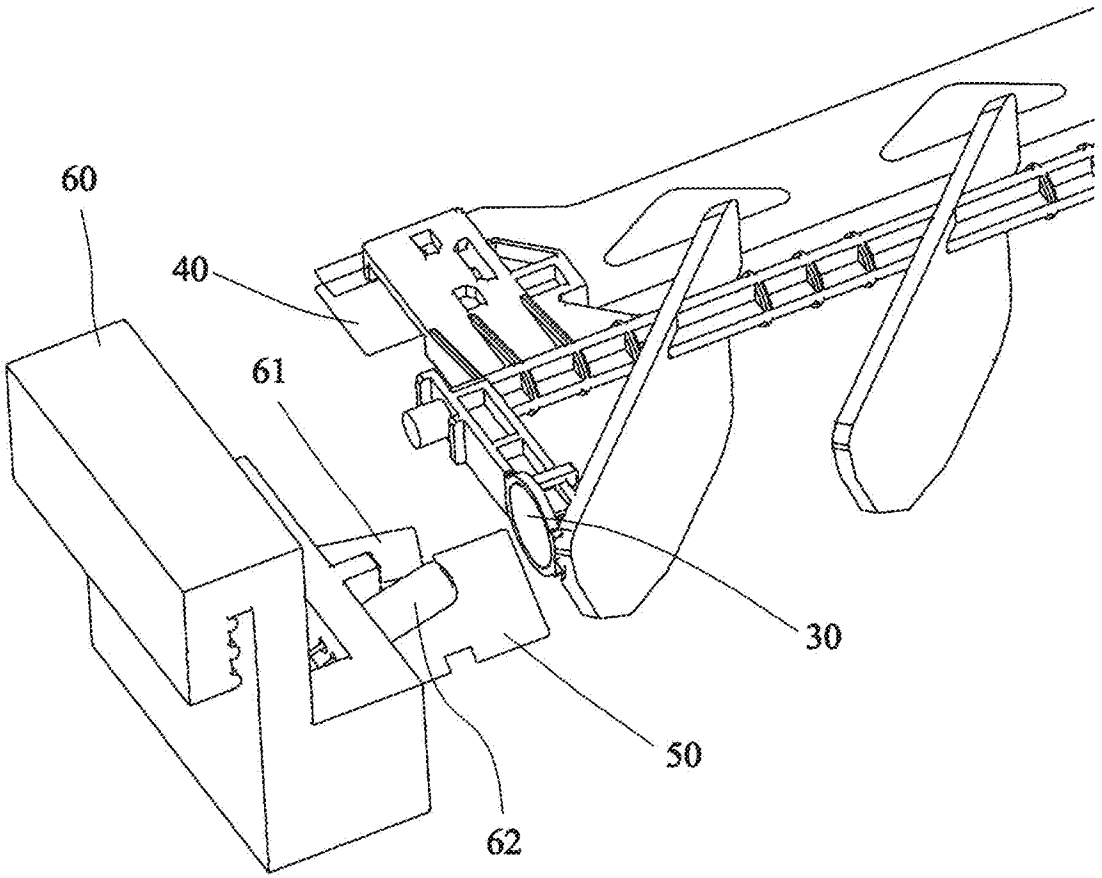
FIG. 11 is an enlarged partial view of FIG. 10 with some members being removed.
Figure 12:
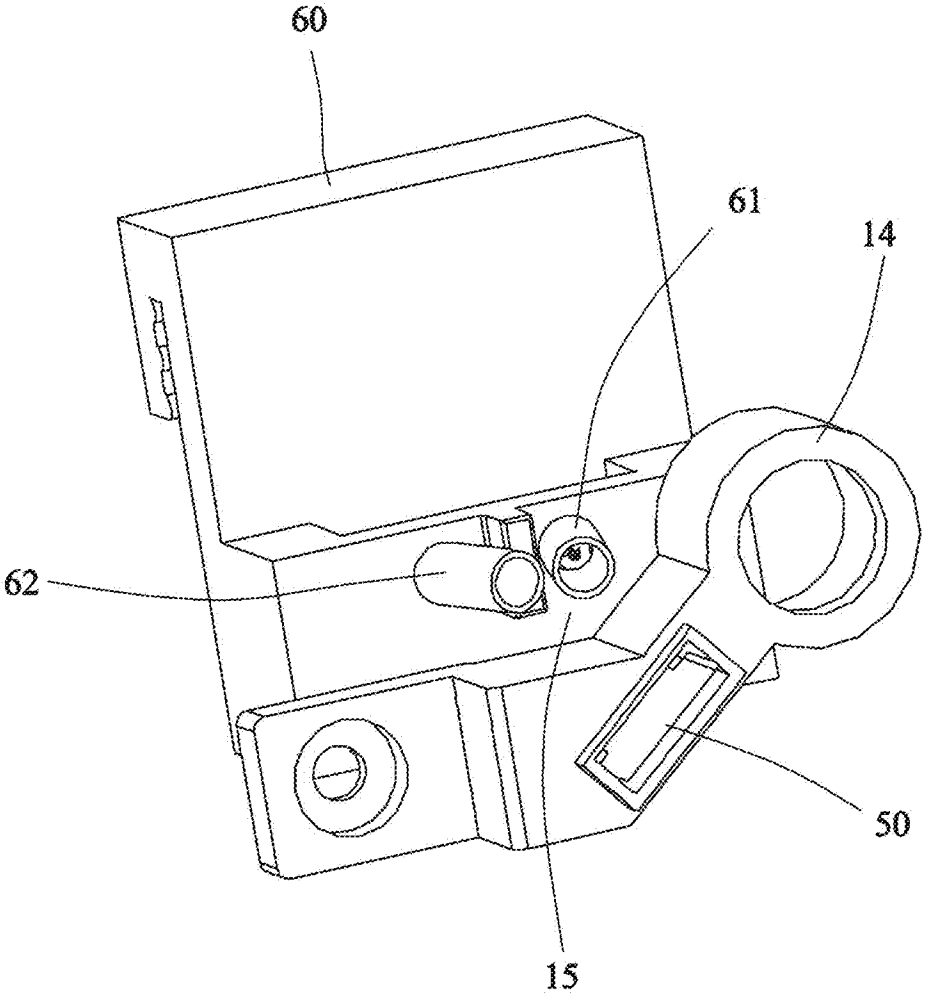
FIG. 12 is a pictorial view showing a transceiver, a second cleaner and a mounting seat.

As shown in FIGS. 10 to 12, the second cleaner 50 is fixed to a mounting seat 14 of the toner cartridge 10, and the agitator 20 is pivotally connected to the mounting seat 14. In addition, the second cleaner 50 is fixed to the mounting seat 14 of the toner cartridge 10, the mounting seat 14 has a notch 15, the emitting signal S1 enters the light-permeable region 12 through the notch 15, and the reflective signal S2 returns to the transceiver 60 through the notch 15. Therefore, the mounting seat 14 has the functions of fixing the second cleaner 50, pivotally connecting to the agitator 20 and allowing the emitting signal S1 and the reflective signal S2 to pass therethrough at the same time.

Figure 13:
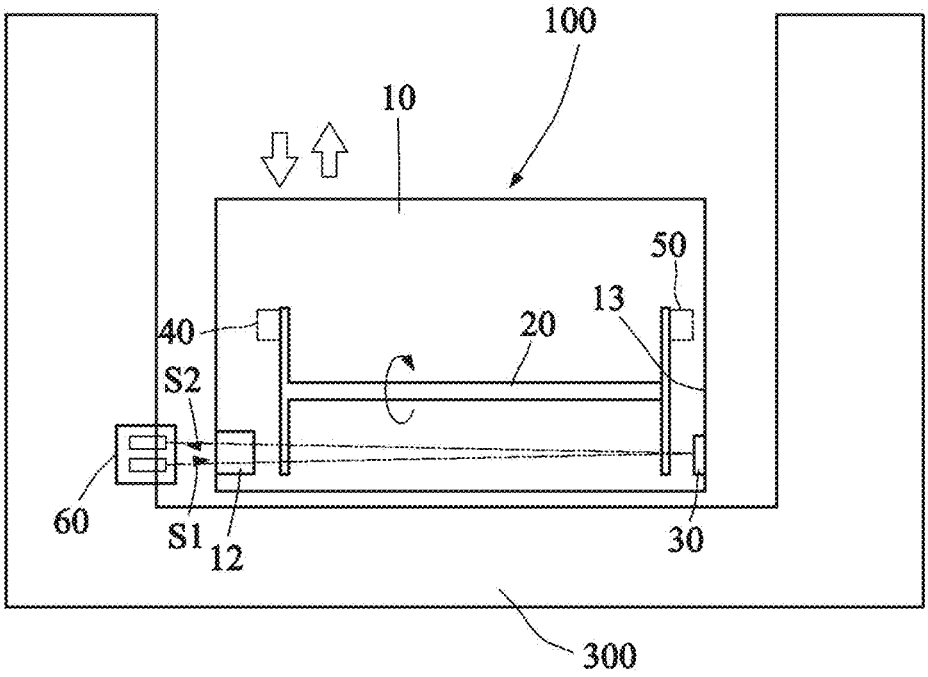
FIG. 13 is a schematic top view showing a toner level detector according to a second embodiment of this disclosure.

As shown in FIG. 13, the toner level detector of this embodiment is similar to the first embodiment, and the difference is that the reflective region 30 is disposed on an inner surface 13 on the other side of the toner cartridge 10. The reflective region 30 may be implemented by the aluminum foil or another reflective sheet, and may also form a reflective portion, such as a white portion, having the reflecting ability using the material of the toner cartridge 10. Therefore, one side of the toner cartridge 10 has a light-permeable region 12, the first cleaner 40 is disposed on one side of the agitator 20, and the second cleaner 50 is disposed on the other side of the agitator 20. The transceiver 60 is disposed on the body 300 outside the toner cartridge 10, and outputs the emitting signal S1 to the reflective region 30 through the light-permeable region 12. The reflective region 30 reflects the emitting signal S1 to generate the reflective signal S2, which is received by the transceiver 60 through the reflective region 30. The rotating first cleaner 40 intermittently cleans the fixed light-permeable region 12, and the rotating second cleaner 50 intermittently cleans the fixed reflective region 30.

In this embodiment, an optical path from the light-permeable region 12 to the reflective region 30 is substantially parallel to an axial direction (or axis) of the agitator 20, and is substantially perpendicular to the direction (as shown by a big arrow), in which the toner cartridge 10 can be pulled out and replaced. It is worth noting that the reflective region may be configured such that a large amount of toner cannot be easily attached to the reflective region, and the second cleaner 50 can be omitted in this case.

Figure 14:
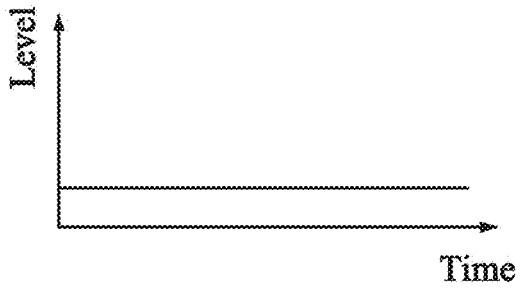
FIGS. 14 and 15 are timing charts showing a reflective signal received by a transceiver.
Figure 15:
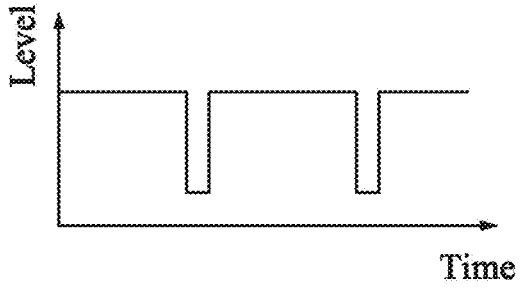

As shown in FIG. 14, a processor (not shown) of the printer judges the toner level as high according to the reflective signal S2 kept at a low level. As shown in FIG. 15, a processor judges the toner level as low according to a period when the reflective signal S2 is kept at a high level accompanying with one or multiple transitory low levels, wherein the transitory low level period is caused when the signal is shielded or blocked by the agitator 20.

Figure 16:
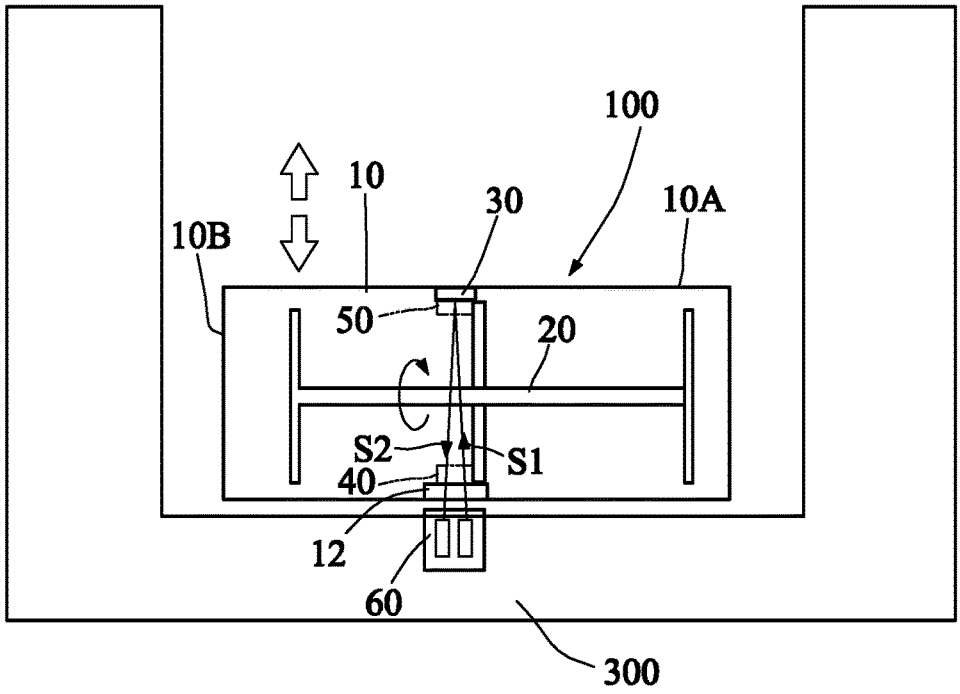
FIG. 16 is a schematic top view showing a toner level detector according to a third embodiment of this disclosure.

As shown in FIG. 16, this embodiment is similar to the second embodiment except for the difference that an optical path from the light-permeable region 12 to the reflective region 30 is substantially perpendicular to an axial direction or axis of the agitator 20, wherein the light-permeable region 12 is disposed on the sidewall (long side 10A), and is substantially perpendicular to the direction (as shown by a big arrow), in which the toner cartridge 10 can be pulled out and replaced.

Figure 17:
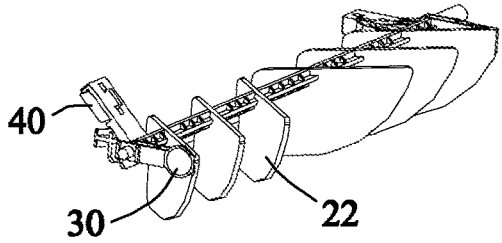
FIGS. 17 and 18 are pictorial views showing two examples of an agitator according to the first embodiment.
Figure 18:
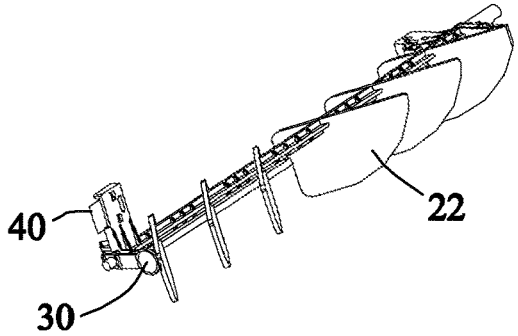

As shown in FIG. 17, a phase difference between the first cleaner 40 and the reflective region 30 is equal to 135 degrees. As shown in FIG. 18, a phase difference between the first cleaner 40 and the reflective region 30 is equal to 90 degrees. In other examples, a phase difference between the first cleaner 40 and the reflective region 30 may be equal to 150, 120, 45 degrees or other values to obtain the better cleaning effect.

With the above-mentioned embodiments of this disclosure, the user can be accurately and timely notified to replace the toner cartridge. Alternatively, a supplemental toner cartridge can supplement the toner, and this is applicable to a dual-box toner cartridge capable of supplying toner according to the requirement, wherein a front end toner box instantly supplies the toner needed for printing, and a rear end toner box is used to store the toner. When the toner level of the front end toner box is judged to be low, the rear end toner box properly supplements the toner to the front end toner box. Such the operation can prevent the unused toner from being constantly agitated to affect the physical property of the unused toner (i.e., the lifetime of the toner can be lengthened). In addition, the embodiment of this disclosure is better than the infrared transmissive detection method because only the detector needs to be mounted on one single side, so that the electronic parts can be decreased and the assembling time can be shortened. Compared with the vibration detection method, the structure of the toner cartridge is relatively simple, the sensor needs not to be disposed inside the toner cartridge, and the electronic cables need not to be connected to the toner cartridge. Compared with the print quantity calculation method, the embodiments of this disclosure can obtain the more accurate results and can accurately determine the current toner level, and the continuously rotating reflective region can obstruct the circulation of the toner.

While this disclosure has been described by way of examples and in terms of preferred embodiments, it is to be understood that this disclosure is not limited thereto. To the contrary, it is intended to cover various modifications. Therefore, the scope of the appended claims should be accorded the broadest interpretation so as to encompass all such modifications.

What is claimed is:

1. A toner level detector, comprising:

a toner cartridge storing toner and having a light-permeable region;

an agitator, which is rotatably disposed in the toner cartridge and agitates the toner;

a reflective region disposed on the agitator;

a first cleaner disposed on the agitator;

a second cleaner disposed on the toner cartridge; and a transceiver, which is disposed on a body outside the toner cartridge, and outputs an emitting signal to the reflective region through the light-permeable region, wherein the reflective region reflects the emitting signal to generate a reflective signal received by the transceiver through the reflective region, wherein the first cleaner, which is rotating, intermittently cleans the light-permeable region, which is fixed; and the second cleaner, which is fixed, intermittently cleans the reflective region, which is rotating.

2. The toner level detector according to claim 1, wherein the second cleaner is disposed near the light-permeable region.

3. The toner level detector according to claim 1, wherein a phase difference between the first cleaner and the reflective region based on a rotation direction of the agitator is equal to 180, 150, 135, 120, 90 or 45 degrees.

4. The toner level detector according to claim 1, wherein the reflective region is rotated to a position opposite the light-permeable region only after the second cleaner, which is fixed, cleans the reflective region, which is rotating.

5. The toner level detector according to claim 1, wherein the second cleaner is fixed to a mounting seat of the toner cartridge, and the agitator is pivotally connected to the mounting seat.

6. The toner level detector according to claim 1, wherein the second cleaner is fixed to a mounting seat of the toner cartridge, the mounting seat has a notch, the emitting signal enters the light-permeable region through the notch, and the reflective signal returns to the transceiver through the notch.

7. The toner level detector according to claim 1, wherein: a toner level of the toner is judged as high according to the reflective signal kept at a low level; and the toner level is judged as low according to a period when the reflective signal is kept at the low level accompanying with one or multiple transitory high levels.

8. The toner level detector according to claim 7, wherein when the toner level is judged as low, a supplemental toner cartridge is enabled to supplement new toner into the toner cartridge.

* * * * *